US006799512B2

(12) United States Patent
Hoffmann et al.

(10) Patent No.: US 6,799,512 B2
(45) Date of Patent: Oct. 5, 2004

(54) RUBBER CYLINDER SLEEVE FOR OFFSET PRINTING PRESSES

(75) Inventors: Eduard Hoffmann, Bobingen (DE); Georg Schmid, Neusäss (DE); Stefan Albrecht, Neusäss (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/606,544

(22) Filed: Jun. 26, 2003

(65) Prior Publication Data

US 2004/0000243 A1 Jan. 1, 2004

(30) Foreign Application Priority Data

Jun. 27, 2002 (DE) ..... 102 28 686

(51) Int. Cl.[7] ..... B41F 13/10; B41F 27/06; B41F 7/02

(52) U.S. Cl. ..... 101/376; 101/375; 101/216; 101/217; 101/177; 428/909

(58) Field of Search ..... 101/177, 181, 101/216, 217, 375, 376; 428/909, 297

(56) References Cited

U.S. PATENT DOCUMENTS 1,999,733 A * 4/1935 Luchrs ..... 428/172
3,700,541 A 10/1972 Shrimpton et al.
3,887,750 A 6/1975 Duckett et al.
4,770,928 A * 9/1988 Gaworowski et al. ..... 442/221
5,215,013 A * 6/1993 Vrotacoe et al. ..... 101/217
5,323,702 A 6/1994 Vrotacoe et al.
5,440,981 A 8/1995 Vrotacoe et al.
6,283,027 B1 * 9/2001 Vrotacoe et al. ..... 101/376
6,374,734 B1 4/2002 Gaffney et al.
6,386,100 B1 5/2002 Gaffney et al.
6,484,632 B2 * 11/2002 Hoffmann et al. ..... 101/217

FOREIGN PATENT DOCUMENTS

EP 0 421 145 4/1991

* cited by examiner

*Primary Examiner*—Andrew H. Hirshfeld
*Assistant Examiner*—Marissa Ferguson
(74) *Attorney, Agent, or Firm*—Cohen, Pontani, Lieberman & Pavane

(57) ABSTRACT

A rubber cylinder sleeve for an offset printing press includes an inner carrier sleeve that has a circumferential and an axial direction. The carrier is expandable outwardly by an application of compressed air from the interior. The rubber cylinder sleeve also includes a single rubber layer having an inner surface disposed on the inner carrier sleeve and an outer surface for contacting the printing plate. The single rubber layer includes a plurality of compressible elements for increasing the compressibility of the single rubber layer and a plurality of filaments for increasing the stiffness of the single rubber layer. The compressible elements and the filaments are disposed at a distance from the outer surface.

13 Claims, 1 Drawing Sheet

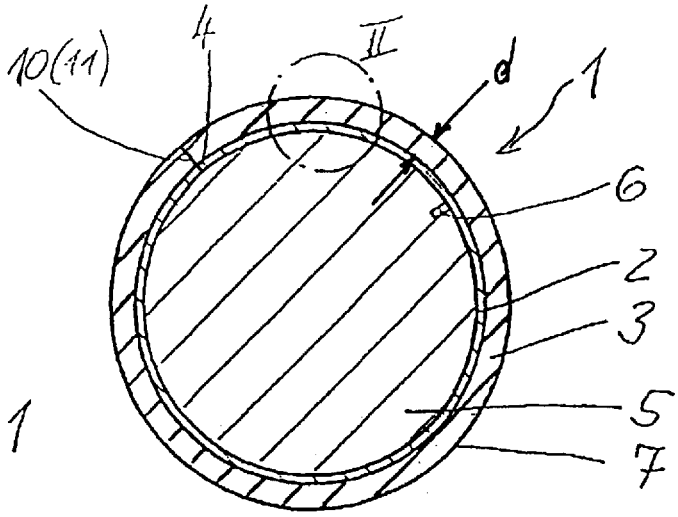
Fig.1
Fig.2
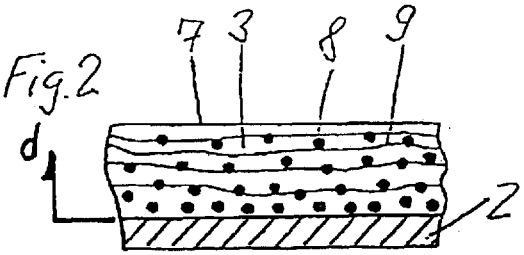
FIG. 2A
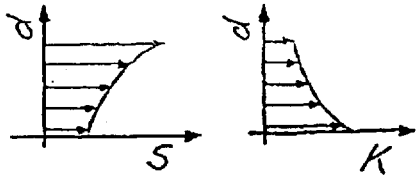
Fig.3
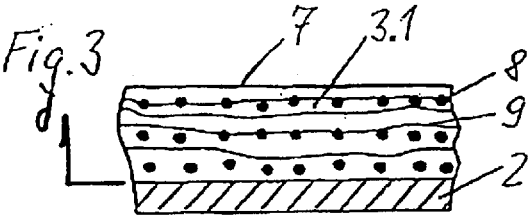
FIG. 3A.
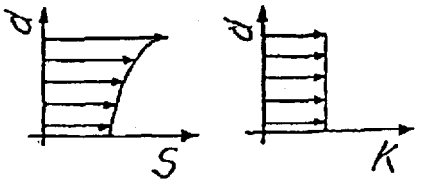
Fig.4
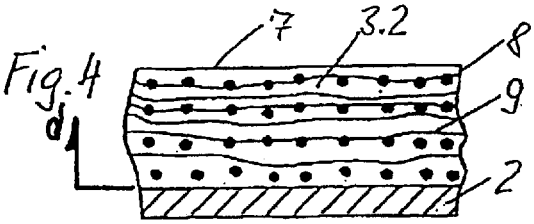
FIG. 4A
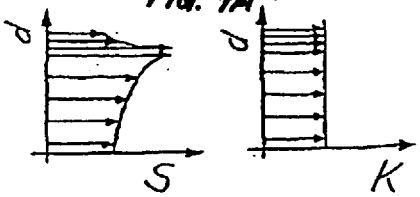

RUBBER CYLINDER SLEEVE FOR OFFSET PRINTING PRESSES

BACKGROUND OF THE INVENTION

1. Field of the Invention

The invention relates to a rubber cylinder sleeve for an offset printing press.

2. Description of the Related Art

EP 0 421 145 B1 discloses a rubber cylinder sleeve in which a carrier sleeve is provided with a rubber covering. In various embodiments, it is disclosed that the rubber covering includes four or more layers. Owing to the multilayer structure, the fabrication of the rubber cylinder sleeve is complicated and the sleeve is correspondingly expensive.

SUMMARY OF THE INVENTION

It is an object of the present invention to provide a rubber cylinder sleeve that is constructed simply.

This and other objects are achieved using a single-layer construction wherein the rubber cylinder sleeve can be produced cost-effectively with little complexity.

A rubber cylinder sleeve for an offset printing press includes an inner carrier sleeve that has a circumferential and an axial direction. The carrier is expandable outwardly by an application of compressed air from the interior. The rubber cylinder sleeve also includes a single layer rubber covering having an inner surface disposed on the inner carrier sleeve and an outer surface for contacting a printing plate. The single rubber layer includes a plurality of compressible elements for increasing the compressibility of the single rubber layer and/or a plurality of filaments for increasing the stiffness of the single rubber layer. The compressible elements and the filaments are spaced from the outer surface.

In one or more embodiments, the density of the compressible elements and/or the filaments are varied through the single rubber layer so as to advantageously change the compressibility and/or stiffness of the rubber layer.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

FIG. 1 is a cross-sectional view of a rubber cylinder sleeve.

FIG. 2 is a view of detail 11 of FIG. 1 illustrating the structure of the layer of the rubber cylinder structure.

FIG. 2*a* is a diagram of the stiffness S and relative compressibility K over the depth d of the rubber cylinder layer of FIG. 2.

FIGS. 3 and 4 are views of embodiments of the rubber cylinder layers.

FIGS. 3*a* and 4*a* are diagrams of the stiffness S and the relative compressibility K over the depth d of the rubber cylinder layer of FIGS. 3 and 4, respectively.

DETAILED DESCRIPTION OF THE PRESENTLY PREFERRED EMBODIMENTS

The rubber cylinder sleeve shown in FIG. 1 includes an inner carrier sleeve 2 which can be expanded by air and on which there is fitted a rubber covering which consists of a single rubber layer 3. The carrier sleeve 2 may be made of a metal, for example steel, and is produced from a plate whose ends are welded together, so that the butt joint 4 results.

However, the carrier sleeve 2 can also be designed to be endless, that is to say without a butt joint 4, for example produced from nickel by electroplating. In addition, the carrier sleeve 2 can be made of plastic, for example a fiber-reinforced epoxy resin, such as GRP. The carrier sleeve 2 may be expanded resiliently by means of compressed air and in this way can be pushed axially onto a printing unit cylinder 5. The latter is also indicated in FIG. 1. Cylinder 5 has passages 6, with which the compressed air for expanding the carrier sleeve 2 can be supplied.

The layer 3 is likewise provided with a joint 10, such as a butt joint. The layer 3 may be adhesively bonded or vulcanized onto the carrier sleeve 2, where joint 10 may be implemented as a bonded joint. Likewise, layer 3 may also include a gap 11 which, if appropriate, is filled with a resilient material. The layer 3 can advantageously also be endless, that is to say without a joint 10 or gap 11.

FIG. 2 is a view of a detail of the construction of the layer 3. Layer 3 is applied to the carrier sleeve 2 and, at a distance from the outer surface 7, contains compressible elements 8, for example in the form of air pockets, and filaments 9 that influence the stiffness. The filaments 9 are aligned approximately in the circumferential direction of the rubber cylinder sleeve 1 and advantageously have a length of about 10 to 30 mm.

In one embodiment, instead of the air pockets, compressible elements 8 are compressible fibers.

The layer 3 consists of a rubber material, such as is normally used for rubber blankets. Both the compressible elements 8, i.e. air pockets, and the filaments 9 are not uniformly distributed in the layer 3. In the radial direction, more compressible elements 8 are arranged towards the carrier sleeve 2, while the filaments 9 are arranged more densely towards the outer surface 7 in the radial direction. Thus, as shown in FIG. 3*a,* the stiffness S increases outwardly in the region of the thickness d of the layer, while the relative compressibility K increases towards the carrier sleeve 2. The stiffness S and the relative compressibility K are also indicated for the region of the thickness d in FIG. 1.

FIGS. 3 and 4 are views of embodiments in accordance with the present invention wherein the distribution of the compressible elements 8, i.e. air pockets, and of the filaments 9 are varied. For simplicity, the reference symbols according to FIG. 2 have largely been maintained. As shown in FIG. 3, the filaments 9 are arranged more densely in a layer 3.1 (corresponding to layer 3 of FIG. 2) towards the outer surface 7, so that the stiffness S increases in this direction as shown in FIG. 3*a*. The compressible elements 8, i.e. air pockets, are distributed uniformly, so that the relative compressibility K is the same over the entire thickness of the layer 3.1, as shown in FIG. 3*a*.

As shown in FIG. 4, in a layer 3.2 (corresponding to layer 3 of FIG. 2) the filaments 9 are arranged more densely towards the outer surface 7, but ultimately then towards the outer surface 7 arranged with a greater spacing again. Stiffness is correspondingly greater in regions having more filaments 9. Given the selected uniform distribution of the compressible elements 8, i.e. air pockets, relative compressibility K is constant.

Further variations in the arrangement of the compressible elements 8 and of the filaments 9 in the radial direction are possible. In addition, a layer 3 can also contain only compressible elements 8 or filaments 9. Furthermore, it is also possible to vary the density of the arrangement of the compressible elements 8 and/or of the filaments 9 that influence the stiffness in the axial direction of the carrier sleeve 2. As a result, the transport of the web to be printed and also of the printout can advantageously be improved.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A rubber cylinder sleeve for an offset printing press, the rubber cylinder sleeve consisting of:

an inner carrier sleeve which is expandable outwardly by an application of compressed air; and a single rubber layer having an inner surface bonded to the inner carrier sleeve and an exposed outer surface for contacting a printing plate, said layer containing, at a distance from the outer surface, a plurality of compressible elements for increasing the relative compressibility K of the single rubber layer, and a plurality of filaments for increasing the stiffness S of the single rubber layer.

2. The rubber cylinder sleeve for an offset printing press of claim 1, wherein the compressible elements are uniformly distributed in the single rubber layer.

3. The rubber cylinder sleeve for an offset printing press of claim 1, wherein the compressible elements vary in density in a radial direction of the sleeve.

4. The rubber cylinder sleeve for an offset printing press of claim 1 wherein the filaments for increasing stiffness are distributed uniformly in the single rubber layer.

5. The rubber cylinder sleeve for an offset printing press of claim 1, wherein the filaments for increasing stiffness vary in density in a radial direction of the sleeve.

6. The rubber cylinder sleeve for an offset printing press of claim 1, wherein the compressible elements are air pockets.

7. The rubber cylinder sleeve for an offset printing press of claim 1, wherein the compressible elements are compressible fibers.

8. The rubber cylinder sleeve for an offset printing press of claim 1, wherein the single rubber layer is endless.

9. The rubber cylinder sleeve for an offset printing press of claim 1, wherein the single rubber layer includes a joint.

10. The rubber cylinder sleeve for an offset printing press of claim 1, wherein the single rubber layer includes a gap.

11. The rubber cylinder sleeve for an offset printing press of claim 1 wherein the single rubber layer is adhesively bonded to the inner carrier sleeve.

12. The rubber cylinder sleeve for an offset printing press of claim 1, wherein the single rubber layer is vulcanized to the inner carrier sleeve.

13. The rubber cylinder sleeve for an offset printing press of claim 1, wherein the compressible elements are disposed in the single rubber layer so that the relative compressibility K of the single rubber layer increases continuously from the outer surface to the inner surface, and the filaments are disposed in the single rubber layer so that the stiffness S of the single rubber layer increases continuously from the inner surface to the outer surface.

* * * * *